United States Patent [19]

Gruber

[11] Patent Number: 4,703,893

[45] Date of Patent: Nov. 3, 1987

[54] HAND SHOWER

[75] Inventor: Walter F. Gruber, Stuttgart, Fed. Rep. of Germany

[73] Assignee: Hansa Metallwerke AG, Fed. Rep. of Germany

[21] Appl. No.: 839,963

[22] Filed: Mar. 17, 1986

[30] Foreign Application Priority Data

Mar. 16, 1985 [DE] Fed. Rep. of Germany ..... 3509602

[51] Int. Cl.[4] ..... B05B 1/18

[52] U.S. Cl. ..... 239/391; 239/449; 239/600

[58] Field of Search ..... 239/444, 445, 449, 436, 239/600, 447, 390, 391, 396, 436, 448, 449, 380, 381

[56] References Cited

U.S. PATENT DOCUMENTS

| | | | |
|---|---|---|---|
| 2,912,168 | 11/1957 | Kumpman | 239/428.5 X |
| 3,672,392 | 8/1972 | Kint | 239/449 X |
| 3,722,798 | 3/1973 | Bletcher et al. | 239/449 X |
| 4,203,556 | 5/1986 | On | 236/449 X |
| 4,204,646 | 3/1980 | Shames et al. | 239/449 X |
| 4,330,089 | 5/1982 | Finkbeiner | 239/449 X |
| 4,629,124 | 12/1986 | Gruber | 239/448 X |

FOREIGN PATENT DOCUMENTS

| | | | |
|---|---|---|---|
| 79/00690 | 9/1979 | PCT Int'l Appl. | 239/390 |

*Primary Examiner*—Andres Kashnikow
*Assistant Examiner*—Kevin Patrick Weldon
*Attorney, Agent, or Firm*—Fred Philpitt

[57] ABSTRACT

Hand showers of different functions all have the same casing, which comprises solely channels of non-specific function and non-specific connection means for carrying water. A first inner insert comprises complementary, non-specific connection means, by which a connection to the casing for the water is provided as well as channels of exclusively large area carrying water and which now have a specific function. Finally, all the channels carrying water, which possibly tend to become blocked on account of their small cross section, and all other parts possibly requiring maintenance are combined in an outer insert of specific function, into which the water flows from the inner insert.

2 Claims, 8 Drawing Figures

Fig.2a
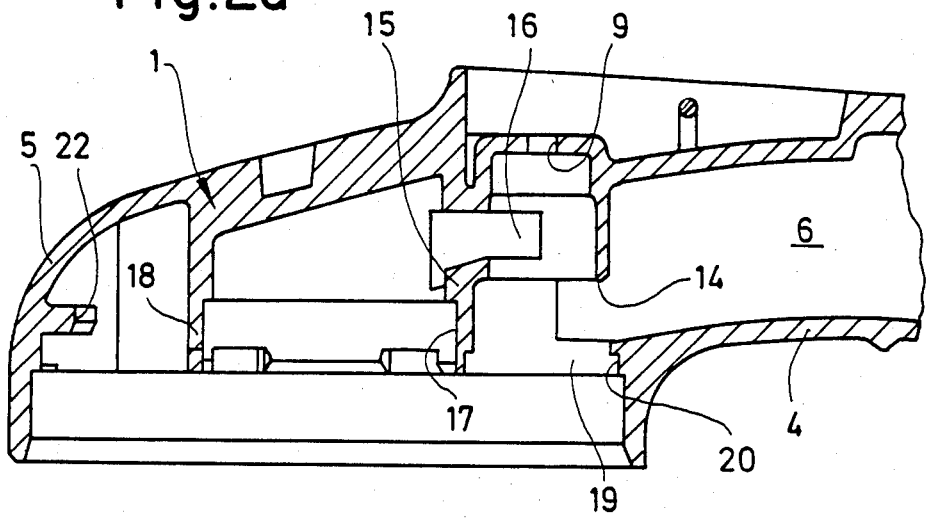
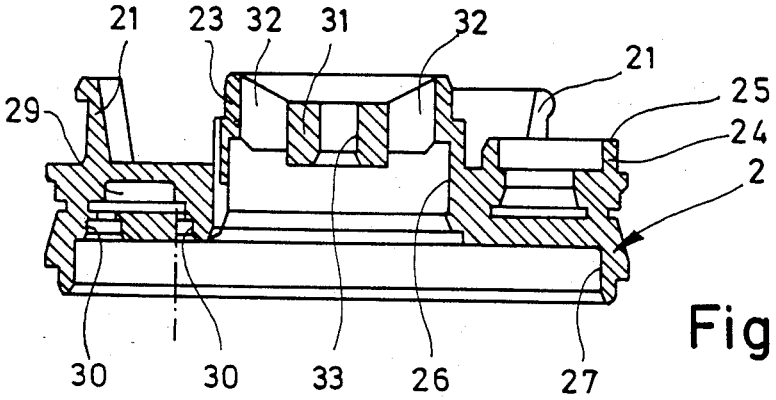
Fig.2b
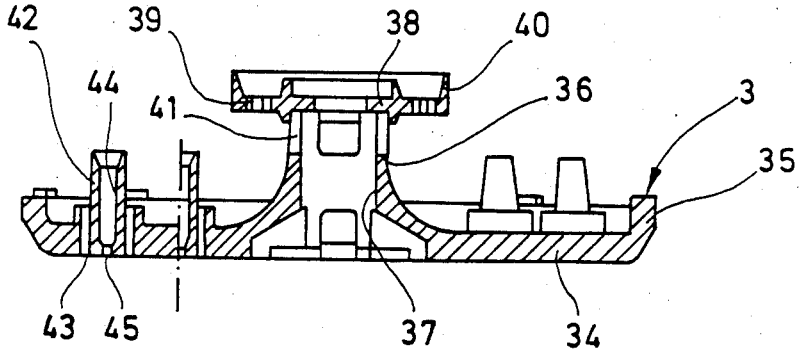
Fig.2c

Fig. 4a
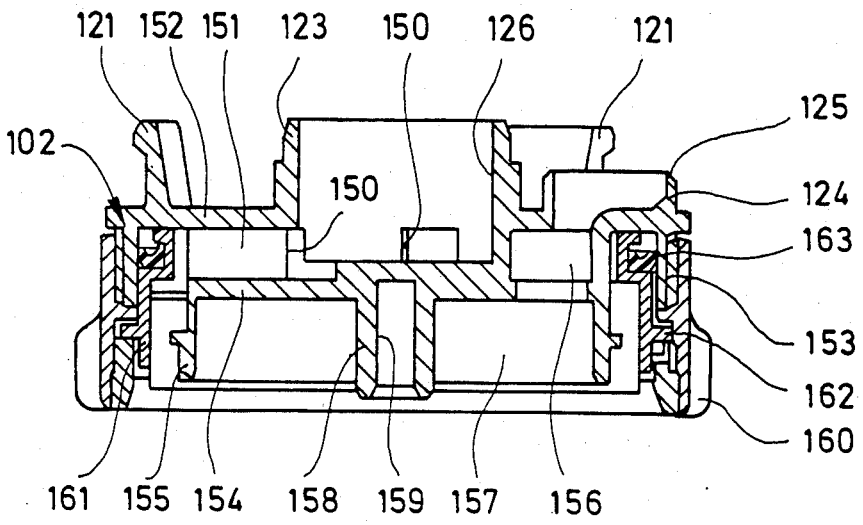
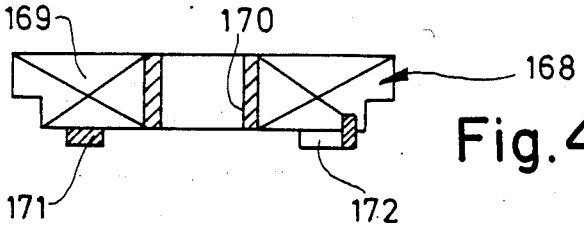
Fig. 4b
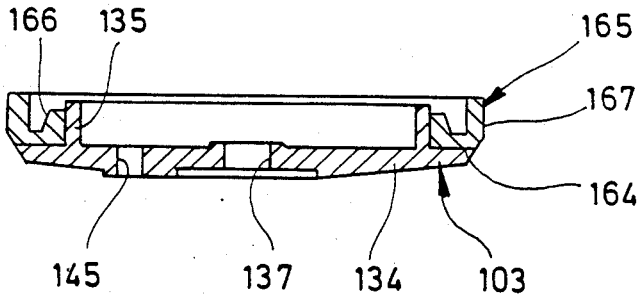
Fig. 4c

HAND SHOWER

The invention relates to a hand shower, which comprises a casing with a handle and a bell-shaped end part; with a water supply chamber extending through the handle; with at least one insert located in the bell-shaped end part, which contains channels carrying water; with a base plate, which closes off the bell-shaped end part on the lower side, with a plurality of outlet recesses and/or through holes for the water in the region of the base plate.

A hand shower of this type is described in German OS No. 34 13 552 (published 10/24/85). This shower is designed for a quite specific double function: it can be changed over selectively from a hard jet to a soft jet operation.

In the sanitary field, in recent times showers with the most varied functions have been desired and used, whereby in individual cases even several functions can be combined in one shower. One example for this is the embodiment described in the above mentioned German OS No. 34 13 552. Despite the use of such showers with multiple functions it is however necessary that shower manufacturers offer several different types of shower with different functions. Hitherto these different types of showers were each produced with an independent construction and required completely specific parts.

It is the object of the present invention to design a hand shower of the aforementioned type so that on the one hand it is particularly easy to maintain and on the other hand can be produced particularly economically as part of entire set of different showers.

This object is achieved according to the invention due to the fact that (a) The casing comprises solely channels of non-specific function independent of the exact shower function and solely likewise non-specific connection means;

(b) A first inner insert is provided, which contains non-specific connection means complementing the connection means of the casing, starting from which are channels of specific function and exclusively of large surface;

(c) A second outer insert of specific function is provided, on which all water-carrying channels of narrow cross section and possibly other parts requiring maintenance are combined.

Thus, according to the invention, the shower may be divided into three main structural units: the casing is designed in a non-specific manner so that it can be used in the same way in all showers of different functions of a set of showers. The transition from the non-specific casing to channels of exclusively large surface, which carry water but are now of specific function takes place by way of a first inner insert. These large surface channels generally require no maintenance, so that this first inner insert can remain permanently in the casing.

The third main structural unit is then the outer insert which is naturally likewise of specific function, which combines all the parts requiring maintenance, in particular the outlet channels and openings of small cross section.

The inner insert may be attached to the casing by a resilient locking connection. This locking connection is therefore provided particularly because in general the inner insert no longer needs to be detached from the casing on account of the fact that it is free from maintenance.

The outer insert is advantageously attached to the inner insert by a central screw. The outer insert with all its parts requiring maintenance can then be removed by releasing this central screw; the parts requiring maintenance are therefore easily accessible.

In showers of this type, in which in one type of operation the water flows through sleeves passing through the base plate and in another through annular slots, which surround the sleeves in the base plate (German OS No. 34 13 552.9), it is appropriate if the sleeves are formed in one piece on the base plate and connected to the latter by way of several radial ribs, which bridge the respective surrounding annular slot. This arrangement is thus quite different to that provided in German OS No. 34 13 552, where the sleeves are not attached to the base plate.

In such showers, in which the water is enriched with air through a perforated plate arranged centrally (German OS No. 34 13 552), it is an advantage if the perforated plate is arranged on the outer insert and connected to the base plate by way of a neck. The perforated plate possibly requiring maintenance after a certain time can in this way be removed from the hand shower together with the outer insert.

For hand showers of this type, in which a variable jet ring emerges by way of grooves on the peripheral surface of a part, it is recommended that the grooves are constructed on a shaped part consisting of resilient material, which is located on the outer insert.

The shaped part may appropriately be located on an annular surface of the base plate, which is defined on the radially inner side by a collar of the base plate.

Finally it is an advantage if the shaped part comprises a sealing bead, which seals the outer insert with respect to the inner insert.

Embodiments of the invention will be described in detail hereafter with reference to the drawings, in which:

FIG. 2 shows the three main structural units of which the hand shower illustrated in FIG. 1 is composed; in FIG. 2(*a*) the casing, FIG. 2(*b*) the inner insert and in FIG. 2(*c*) the outer insert;

FIG. 4 shows two of the three main structural units from which the hand shower shown in FIG. 3 is composed an outer casing FIG. 4*a*; a turbine wheel FIG. 4(*b*) and an outer insert FIG. 4(*c*).

Figure 1:
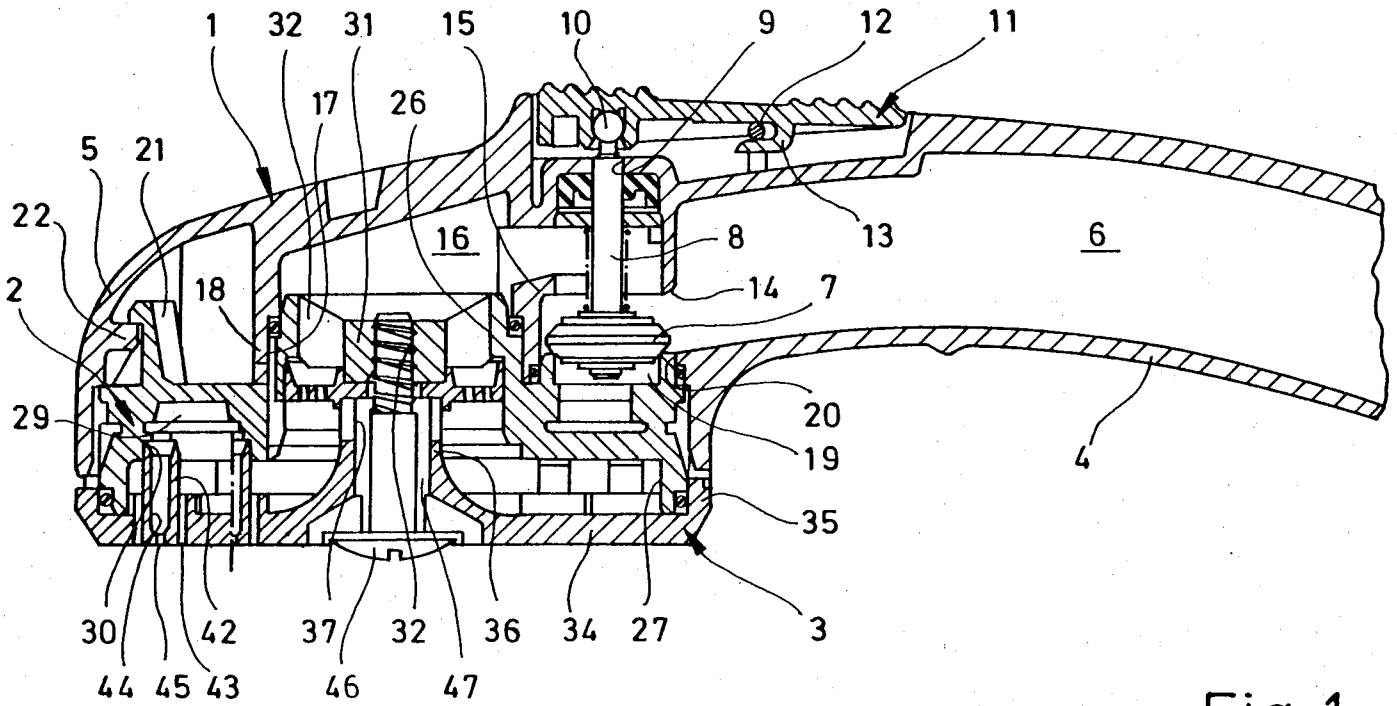
FIG. 1 is a section through a first embodiment of a hand shower (cut off in the region of the handle)

The hand shower illustrated in FIGS. 1 and 2 is suitable for selective hard jet and soft jet operation. It is composed essentially of three main structural units, namely a casing 1 (FIG. 2*a*), a first inner insert 2 (2*b*) and a second outer insert 3 (FIG. 2*c*). The casing 1 is designed so that it is uniformly suitable for various shower models, which may have different functions. The outer insert 3 combines all those components in which there is a danger of blockage on account of the small cross section of flow or in which maintenance may be necessary at certain intervals for other reasons. The outer insert 3 is individually designed to correspond to the respective shower function. Finally, the inner insert 2 contains all those water-carrying channels which are necessary for a passage between the waterways in the casing 1 (not individualised with a specific function) to the waterways in the outer insert 3 individualised with a specific function.

The construction of the main structural units 1, 2, 3 is as follows in detail:

The one-piece casing 1 extends from a handle 4, which is only partly shown, into a bell-shaped end part 5. The handle 4 thus encloses a water supply chamber 6. A spring-loaded double valve cone 7 in the transistion region between the handle 4 and bell-shaped end part 5 is actuated by way of a valve stem 8, which is guided in a sealed manner through a bore 9 in the casing 1 and ends in a round head 10. The head 10 of the valve stem 8 is forced resiliently into a corresponding receiving opening on the underside of an actuating member 11. The actuating member 11 is placed by a neck 13 over an abutment 12 of the casing 1 injected in one-piece and is able to carry out a rocking-type movement about the abutment 12.

The double valve cone 7 cooperates with a first valve seat 14, which is formed on a dividing wall 15 of the casing 1. The chamber 16 above the valve seat 14 is connected to a first circular connecting bore 17 having a relatively large surface, which is located in a collar 18 integral with the casing 1. This extends coaxially with respect to the axis of the bell-shaped end part 3. The chamber 19 below the double valve cone 7 is connected to a second connecting bore 20 of somewhat smaller surface, which is offset eccentrically with respect to the axis of the bell-shaped end part 3.

With the two connecting bores 17 and 20, the casing 1 thus offers two universal, "standardised" connection points, which are suitable for all individual types of shower.

The inner insert 2 (FIG. 2*b*) is fastened in the casing 1 by several hook-like projections 21, which engage resiliently behind inner ribs 22 on the casing 1. A central connection collar 23 of circular cross section of the casing 2 is introduced into the first connecting bore 17 of the casing 1 and sealed by an O-ring with respect to the latter. A second eccentric connection collar 24 likewise of circular cross section is introduced into the connecting bore 20 of the casing 1 so that its upper end face 25 serves as a second valve seat for the double valve cone 7. It is likewise sealed by an O-ring with respect to the connecting bore 20.

Extending through the connecting collar 24 and the entire insert 2 is a bore 26, which opens into a circular recess 27 on the lower end face of the insert 2. The bore 28 penetrating the connecting collar 24 opens into an annular chamber 29, which surround the bore 26 concentrically. The annular chamber 29 is finally connected to the circular recess 27 of the insert 2 by way of a plurality of stepped bores 30.

A cylindrical securing member 31 is held by several radial ribs 32 inside the bore 26 of the connecting collar 24 and concentrically with respect thereto. An axial securing bore 33 extends through the securing member 31.

The outer insert 3 is now constructed as follows and connected to the inner insert 2:

A base plate 34 is provided with a collar 35 on its edge, which engages over the lower end of the inner insert 2 enclosing an O-ring seal. A coaxial neck 36 is formed on the base plate 34, through which a through hole 37 extends. A perforated plate 38 is fitted to the neck 34 (either integrally or is welded or the like), passing through which plate 38 are a plurality of small through holes 39. On the periphery the perforated plate 38 is provided with a peripheral collar 40. The neck 36 comprises several windows 41 directly below the perforated plate 38.

The base plate 34 comprises a plurality of holes, in the centre of which, an upwardly projecting hollow sleeve 42 is held respectively by means of small ribs (not shown) so that coaxial annular slots 43 are formed around the sleeves 42. A through hole 44 passes through each of the sleeves 42, which hole passes into a small jet orifice 45 at the lower end.

The insert 3 is now inserted in the insert 2 (FIG. 1), so that the upper ends of the sleeves 42 come to lie in the stepped bores 30 in the insert 2 and the perforated plate 38 comes to lie inside the bore 26 of the insert 2, abutting against the fixing member 31. The collar 40 of the perforated plate 38 thus bears against the wall of the bore 26.

A central screw 46 is guided through the bore 37 in the insert 3 and screwed into the bore 33 in the fixing member 31.

The possible waterways inside the aforedescribed hand shower and its method of operation are as follows:

In the position of the double valve cone 7 illustrated in FIG. 1, the hand shower is pre-set for soft jet operation. In this case the water flows from the supply chamber 6 by way of the valve seat 14 and the chamber 16 into the bore 26 of the insert 2 and from there through the bores 39 in the perforated plate 38. In this case it is enriched with air which is supplied from the atmosphere by way of the chamber 47 surrounding the screw 46.

The bubbling water enriched with air flows into the recess 27 of the insert 2 forming a water distribution chamber. It emerges from the latter in the form of soft jets by way of the many annular slots 43 in the base plate 34, without any separation of the water and air.

If a hard jet operation of the shower is desired, by tilting the actuating member 11, the double valve cone 7 is moved upwards and laid against the valve seat 14. The water now flows from the supply chamber 4 through the chamber 19 into the annular chamber 29. From there it escapes from the base plate 34 in the form of hard jets not mixed with water by way of the bores 44 and the jet orifices 45 of the sleeves 42. The embodiment of a hand shower illustrated in FIGS. 3 and 4 corresponds as regards the basic construction to the embodiment described above with reference to FIGS. 1 and 2. In so far that parts of the embodiment according to FIGS. 3 and 4 correspond to those of the embodiment according to FIGS. 1 and 2, they are characterised by the same reference numerals increased by 100.

Figure 3:
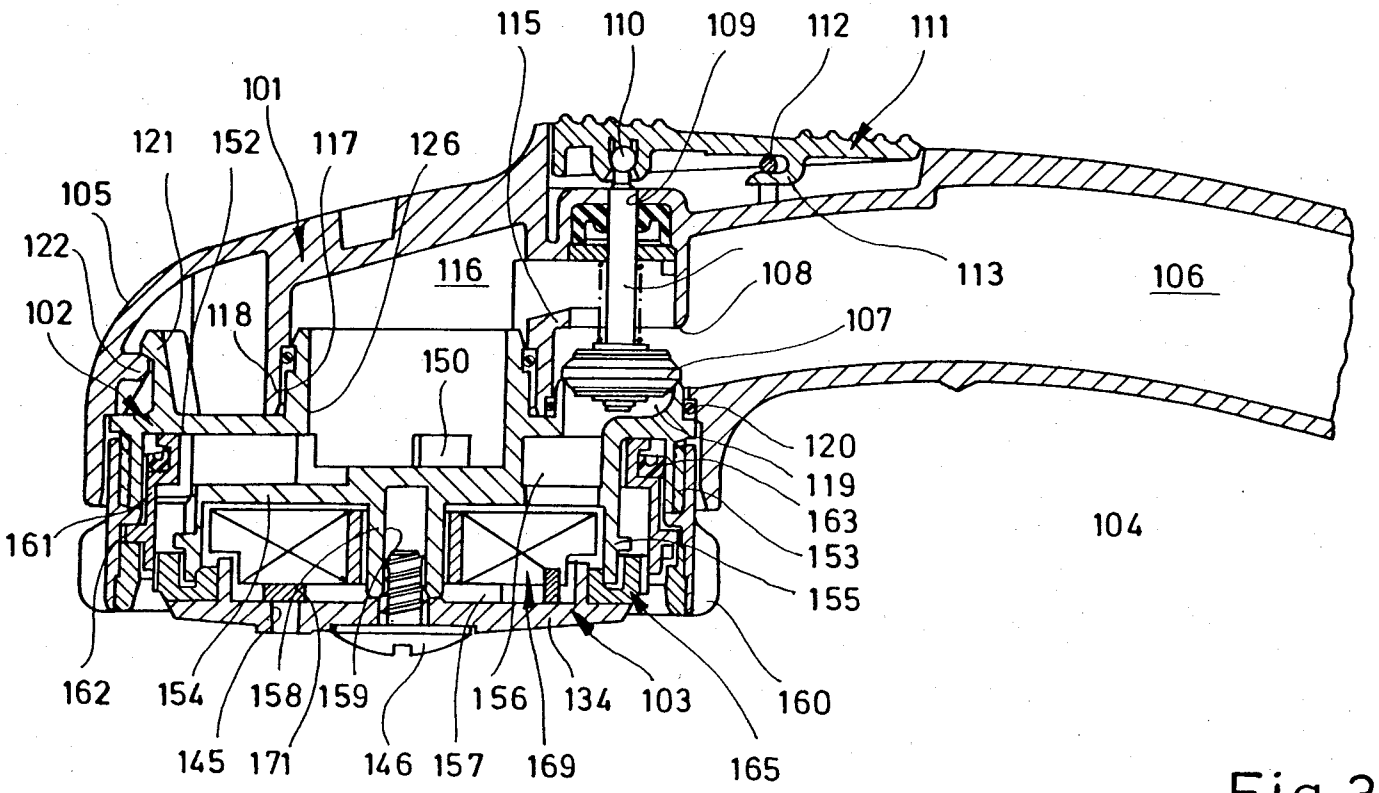
FIG. 3 is a section through a second embodiment of a hand shower (cut off in the region of the handle)

The hand shower illustrated in FIGS. 3 and 4 is either intended for operation with a variable jet ring or with pulsating massage jets. Like the previously described embodiment, it includes three main structural units: a casing 101, an inner insert 102 and an outer insert 103.

The casing 101 corresponds completely to the casing 1 described above with reference to FIG. 2*a*. Reference is made to this.

The inner insert 102 (FIG. 4*a*) is again attached to the casing 101 by the same hook-shaped projections 121, which are engaged behind the casing ribs 122. Also the cylindrical connection collars 123, 124 sink in the same manner into the connecting bores 117 and 120 of the casing 101 as in the embodiment described. However, the further guidance of the water channels of large surface extending inside the insert 102 is different to that in FIGS. 1 and 2 and is adapted to the specific function of the special shower.

The bore 126 of the first connecting collar 123 is not guided through the entire insert 102. It is connected to a first annular chamber 151 by way of several windows 150 directed substantially radially. The first annular chamber 151 is defined by the upper end wall 152 of the insert 102, an outer cylindrical apron 153 connected to its outer region, an inner dividing wall 154 as well as an inner cylindrical apron 155 attached to the outer region of the inner dividing wall 154.

The annular chamber 151 is narrowed down in regions by a bore 156 or its wall, which connects the second connecting collar 124 to a second annular chamber 157. The second annular chamber 157 is defined by the dividing wall 154, the inner apron 153 and a cylindrical projection 158, which extends downwards from the dividing wall 154 coaxially with respect to the overall structure. The cylindrical projection 158 contains a blind fastening hole 159.

The outer cylindrical apron 153 is provided with an external screw thread, onto which a threaded ring 160 composed of two parts is screwed. The threaded ring 160 engages positively around an outer rib 162 of a substantially cylindrical sliding ring 161. The sliding ring 161 projects by its upper region into the annular chamber 151 and is sealed there by a shaped seal 163 against the inner end face of the outer apron 153. The arrangement is obviously such that the sliding ring 161 can be adjusted in the axial direction by screwing the threaded ring 160 on the outer apron 153.

The outer insert 103 (FIG. 4*c*) is again provided with a base plate 134, through which a plurality of bores 145 extend. Formed on the base plate 134 is an upwardly projecting, cylindrical collar 135, the diameter of which however is smaller than the diameter of the base plate 134. This produces an annular surface 164 on the upper side of the base plate 134 on which a shaped part 165 of resilient material rests. The shaped part 165 comprises coaxially with respect to each other an inner sealing bead 166, which bears against the collar 135 of the base plate 134 and an outer cylindrical collar 167, on whose outer surface grooves extending approximately axially of varying depth and inclination (not shown in the drawing) are formed.

The outer insert 103 is attached to the insert 102 by means of a screw 146, which penetrates a bore 137 in the base plate 134 and is screwed into the fastening bore 159 of the insert 102 so that the sealing bead 166 of the shaped seal 165 seals the collar 135 of the outer insert 103 with respect to the inner apron 155 of the inner insert 102.

The cylindrical collar 167 of the shaped part 165 thus engages around the lower end of the inner apron 155 of the insert 102.

The turbine wheel 168 illustrated in FIG. 4*b* is located in the annular gap 157 sealed in this way between the inserts 102 and 103. It comprises several radial vanes 169, emanating from a hub 170. The hub 170 is slid over the cylindrical projection 158 of the inner insert 102.

Some vanes 169 support a cover plate 171 in the shape of a circular arc, which rests on the upper side of base plate 134 of the insert 103 and according to the rotary position releases or closes off certain through holes 145 in the base plate 134. Other vanes 169 of the turbine wheel 168 support a counter-weight 172, which ensures smooth running of the turbine wheel 168.

The operation of the hand shower described above is as follows:

In the position of the double valve cone 107 illustrated in FIG. 3, water flows from the water supply chamber 106 by way of the valve seat 114, the chamber 116, the bore 126 of the inner insert 102 and the windows 150 into the annular chamber 152. From there water flows in the axial direction between the sliding ring 161 and the inner apron 155 of the inner insert 102 to the shaped part 165. The water then escapes as a jet ring through the grooves in the cylindrical collar 167 of the shaped part 165, the pattern of the jets being able to be varied by the axial position of the sliding ring 161.

If by means of the actuating member 111 the double valve cone 107 is placed against the upper valve seat 114, then water flows by way of the bore 156 into the annular chamber 157, at this point sets the turbine wheel 168 in rotation and escapes by way of the through holes 145 in the base plate 134. These water jets pulsate, since they are interrupted periodically by the cover plate 171 of the turbine wheel 168.

I claim:

1. A handshower set which is capable of carrying out a plurality of different fluid spray patterns and functions, which set comprises (a) single casing that includes a handle integrally connected to a bell-shaped end part and which is provided with an interior water supply channel.

(b) a plurality of different intermediate inserts that are engageable with the bell-shaped end part of said single casing and which are constructed to receive the flow of water from said casing and to thereafter provide an intermediate modification of the direction of flow of that water through the bell shaped end part, and (c) a plurality of different outer inserts that are engageable with said intermediate inserts and which are constructed to receive the flow of water from said intermediate inserts and to thereafter finally modify the flow of water exiting from the handshower, whereby (1) by appropriate selection of the intermediate insert and the outer insert for engagement with each other and with said casing, one may obtain any one of a plurality of different types of fluid flow from the handshower, and (2) maintenance, repair and replacement are facilitated and made more economical.

2. An assemblage of components for producing a variety of different handshower units that have a variety of different fluid spray patterns, each assembled hand shower unit consisting of only three parts that fit together to define the channels through which water will flow, the three essential combineable components being selected from one of each of the following three categories.

(a) a single casing that includes a handle integrally connected to a bell-shaped end part and which is provided with an interior water supply channel, (b) a plurality of different intermediate inserts that are engageable with the bell-shaped end part of said single casing and which are constructed to receive the flow of water from said casing and to thereafter provide an intermediate modification of the direction of flow of that water through the bell shaped end port, and (c) a plurality of different outer inserts that are engageable with said intermediate inserts and which are constructed to receive the flow of water from said intermediate inserts and to thereafter finally modify the flow of water exciting from the handshower whereby (1) by appropriate selection of the intermediate insert and the outer insert for engagement with each other and with said casing, one may obtain any one of a plurality of different types of fluid flow from the handshower, and (2) maintenance, repair and replacement are facilitated and made more economical.

* * * * *